US006156679A

United States Patent [19]

Takaoka et al.

[11] Patent Number: 6,156,679

[45] Date of Patent: Dec. 5, 2000

[54] HEAT-FUSIBLE COMPOSITE FIBER AND NON-WOVEN FABRIC PRODUCED FROM THE SAME

[75] Inventors: Yukinori Takaoka; Mitsuru Kojima; Masayasu Suzuki, all of Shiga, Japan

[73] Assignee: Chisso Corporation, Osaka, Japan

[21] Appl. No.: 09/125,506

[22] PCT Filed: Nov. 26, 1997

[86] PCT No.: PCT/JP97/04321

§ 371 Date: Aug. 20, 1998

§ 102(e) Date: Aug. 20, 1998

[87] PCT Pub. No.: WO98/29586

PCT Pub. Date: Jul. 9, 1998

[30] Foreign Application Priority Data

Dec. 25, 1996 [JP] Japan ..... 8-356025

[51] Int. Cl.[7] ..... D04H 3/12; D02G 3/02

[52] U.S. Cl. ..... 442/327; 442/333; 442/364; 428/373

[58] Field of Search ..... 442/327, 333, 442/364; 428/373

[56] References Cited

FOREIGN PATENT DOCUMENTS

| | | |
|---|---|---|
| 0 518 690 | 12/1992 | European Pat. Off. . |
| 0 557 889 | 9/1993 | European Pat. Off. . |
| 4-018121 | 1/1992 | Japan . |
| 6-108310 | 4/1994 | Japan . |
| 6-330444 | 11/1994 | Japan . |

*Primary Examiner*—Elizabeth M. Cole
*Assistant Examiner*—John J. Guarriello
*Attorney, Agent, or Firm*—McDermott, Will & Emery

[57] ABSTRACT

There is disclosed a heat-fusible composite fiber comprising a sheath component of a crystalline propylene copolymer resin having a low melting point and a core component of a crystalline polypropylene resin having a higher melting point, wherein said fiber has a resistance of incipient tension of 5 to 15 gf/D $\{44.1\times10^{-3}$ to $132.4\times10^{-3}$ N/dtex$\}$ and a heat shrinkage of 15 percent or less at 140° C. over 5 minutes, as well as a non-woven fabric made of such a fiber.

7 Claims, No Drawings

HEAT-FUSIBLE COMPOSITE FIBER AND NON-WOVEN FABRIC PRODUCED FROM THE SAME

TECHNICAL FIELD

The present invention relates to a heat-fusible composite fiber and a non-woven fabric produced from said heat-fusible composite fiber, and more specifically, to a heat-fusible composite fiber which can be used for producing a non-woven fabric exhibiting good adhesion on heat treatment at low temperatures, and having high dimensional stability, high tenacity, and excellent feeling (touch); and to a non-woven fabric produced from said heat-fusible composite fiber.

BACKGROUND ART

Non-woven fabrics manufactured from a low-melting-point resin as the sheath component and a high-melting-point resin as the core component have been well received for their properties such as feeling (touch) and non-woven tenacity, and have widely been used as the surface materials for hygienic products such as paper diapers and sanitary napkins. Such non-woven fabrics are typically manufactured by processing a heat-fusible composite fiber into a web through carding or air-flow opening, then melting the sheath component by heat and pressure, and bonding fiber intermingling points.

Processes forbonding fiber intermingling points are roughly divided into the heat-pressure method using heat embossing rolls, and the hot-air bonding method using a suction band dryer or a suction drum dryer. Non-woven fabrics manufactured by these methods are called point-bonded non-woven fabrics and through-air non-woven fabrics, respectively, and are used according to their applications.

Such fibers known as heat-fusible composite fibers include, for example, a composite fiber consisting of a high-density polyethylene sheath component and a polypropylene core component (hereafter referred to as HDPE/PP-based heat fusible composite fiber), and a composite fiber consisting of a high-density polyethylene sheath component and a polyester core component (hereafter referred to as HDPE/PET-based heat fusible composite fiber). Also included is a composite fiber consisting of a propylene-based copolymer sheath component and a polypropylene core component (hereafter referred to as co-PP/PP-based heat fusible composite fiber) as disclosed in Japanese Patent Publication No. 55-26203, and Japanese Patent Application Laid-open Nos. 4-281014 and 5-9809.

Among these fibers, since the co-PP/PP-based heat fusible composite fiber has propylene components in both resins constituting the sheath and those constituting the core, strong affinity exists between the sheath and core components, and, in contrast to HDPE/PP-based or HDPE/PET-based heat fusible composite fibers, the sheath and the core are not prone to delamination. In addition, since, relative to HDPE, co-PP in the sheath component excels in the ability of heat-sealing with other resins, non-woven fabrics produced from the co-PP/PP-based heat fusible composite fiber are highly evaluated for their high strength when processed into paper diapers or hygienic products together with non-woven fabrics or films produced from other resins.

When a non-woven fabric is produced from a heat fusible composite fiber, the feeling (touch) of the non-woven fabric is incompatible with its tenacity. Conventionally, since non-woven fabrics for hygienic materials are required to have a sufficient tenacity and as fast a production speed as possible, they have often been produced through heat treatment at a relatively high temperature. As are cent trend, however, softer feeling (touch) has been demanded in non-woven fabrics used as the material of hygienic products. Therefore, a lower temperature is often employed for the heat treatment of non-woven fabrics produced from co-PP/PP-based heat fusible composite fibers, resulting in a problem of a lower tenacity of the non-woven fabrics.

For this reason, the development of co-PP/PP-based heat fusible composite fibers is required for producing non-woven fabrics which satisfy the two incompatible demands for high tenacity and soft feeling (touch).

In existing co-PP/PP-based heat fusible composite fibers, however, the difference in melting points between resins used as the materials for the sheath and core components is smaller than that of HDPE/PP-based or HDPE/PET-based heat fusible composite fibers. In addition, orientation and crystallization of the resins occur during the spinning and drawing processes, further decreasing the difference in melting points of the two components. If the heat treatment temperature is raised to attain tenacity sufficient for the non-woven fabric to be used as the surface material of hygienic products, feeling (touch) is degraded and dimensional stability is lowered, raising problems. For example, in point-bonded non-woven fabrics feeling will become hard, and in through-air non-woven fabrics thickness will decrease, bulk will lower, and dimensional stability will lower due to heat shrinkage.

An object of the present invention is to provide a heat-fusible composite fiber which enables the fabrication of non-woven fabrics having high tenacity and excellent feeling (touch) with high dimensional stability, and to provide a non-woven fabric produced by the heat-treatment of said fiber through methods such as heat-and-pressure bonding or hot-air bonding.

DISCLOSURE OF INVENTION

The present inventors conducted repeated examinations for solving the above problems, and found that the above object was achieved by adopting the following constitution.

According to a first aspect of the present invention, there is provided a heat-fusible composite fiber comprising a sheath component of a crystalline propylene copolymer resin having a low melting point and a core component of a crystalline polypropylene resin having a higher melting point, wherein said fiber has a resistance of incipient tension of 5 to 15 gf/D {from $44.1\times10^{-3}$ to $132.4\times10^{-3}$ N/dtex}, and heat shrinkage of 15percent or less at 140° C. over 5 minutes.

According to a second aspect of the present invention, there is provided a heat-fusible composite fiber according to the first aspect, wherein said crystalline propylene copolymer resin having a low melting point is a copolymer resin consisting of 85 to 99 percent by weight of propylene and 1 to 15 percent by weight of ethylene.

According to a third aspect of the present invention, there is provided a heat-fusible composite fiber according to the first aspect, wherein said crystalline propylene copolymer resin having a low melting point is a copolymer resin consisting of 50 to 99 percent by weight of propylene and 1 to 50 percent by weight of butene-1.

According to a fourth aspect of the present invention, there is provided a heat-fusible composite fiber according to the first aspect, wherein said crystalline propylene copolymer resin having a low melting point is a copolymer resin consisting of 84 to 97 percent by weight of propylene, 1 to 10 percent by weight of ethylene, and 1 to 15 percent by weight of butene-1.

According to a fifth aspect of the present invention, there is provided a heat-fusible composite fiber according to any of the first through fourth aspects which has a fiber strength of 1.2 to 2.5 gf/D $\{10.6\times10^{-3}$ to $22.1\times10^{-3}$ N/dtex$\}$, and an elongation of 200 to 500 percent.

According to a sixth aspect of the present invention, there is provided a non-woven fabric made of a heat-fusible composite fiber according to the first aspect, wherein fibers at crossing points are thermally adhered by a hot air method.

According to a seventh aspect of the present invention, there is provided a non-woven fabric made of a heat-fusible composite fiber according to the first aspect, wherein fibers at crossing points are thermally adhered by heat and pressure.

The present invention will be described in detail below.

Crystalline polypropylene, a high-melting-point resin used in the present invention as the core component of the heat-fusible composite fiber, is a crystalline polymer comprising a propylene homopolymer or propylene as the main constituent, and a small amount of one or more members selected from a group consisting of ethylene, butene-1, pentene-1, hexene-1, octene-1, nonene-1, and 4-methyl pentene-1, and preferably is of a fiber grade having an MFR (230° C., 2.16 kg) of 1 to 50 and a melting point of 157° C. or above. Such polymers are obtained by methods well known to those skilled in the art, such as the polymerization of propylene through use of a Ziegler-Natta catalyst.

In contrast, a propylene copolymer which serves as a low-melting-point resin used in the present invention as the sheath component of the heat-fusible composite fiber is a crystalline polymer comprising propylene and one or more members selected from a group consisting of ethylene, butene-1, pentene-1, hexene-1, octene-1, nonene-1, and 4-methyl pentene-1, and has an MFR (230° C., 2.16 kg) of 1 to 50 and a melting point of 110 to 150° C. If the melting point is below the lower limit, the adhesion strength of a non-woven fabric produced from this polymer is low; and if the melting point is above the upper limit, processability is lowered. Preferably, the melting point is 120 to 135° C.

Specifically, such a propylene copolymer includes a propylene-based propylene-ethylene binary copolymer consisting of 85 to 99 percent by weight of propylene and 1 to 15 percent by weight of ethylene, apropylene-based propylene-butenebinary copolymer consisting of 50 to 99 percent by weight of propylene and 1 to 50 percent by weight of butene-1, and a propylene-based propylene-ethylene-butene terpolymer consisting of 84 to 97 percent by weight of propylene, 1 to 10 percent by weight of ethylene, and 1 to 15 percent by weight of butene-1. Such propylene-based binary copolymers and terpolymers are solid polymers formed, for example, by the copolymerization of olefins through use of a known Ziegler-Natta catalyst, and are random copolymers by nature.

If the content of any of the co-monomers (ethylene and butene-1) in the copolymer described above is less than 1 percent by weight, the resultant fibers will be unstable in terms of thermal adhesion. If the melting point of the copolymer is out of the above-mentioned range, any of processing speed, tenacity, or feeling (touch) is deteriorated.

The low-melting-point resin used as the sheath component in the present invention is preferably at least one member selected from a group consisting of polyolefin-based binary copolymers and terpolymers. More specifically, there may be used any of a polyolefin-based binary copolymer alone, a polyolefin-based terpolymer alone, a mixture of optional proportions of two or more polyolefin-based binary copolymers, a mixture of optional proportions of two or more polyolefin-based terpolymers, or a mixture of optional proportions of one or more polyolefin-based binary copolymers and one or more polyolefin-based terpolymers.

In the present invention, the important point is that the resistance of incipient tension of the heat-fusible composite fiber is preferably made 15 gf/D $\{132.4\times10^{-3}$ N/dtex$\}$ or less, and more preferably 10 gf/D $\{88.3\times10^{-3}$ N/dtex$\}$ or less, by inhibiting the orientation and crystallization of the resin during all the processes from spinning through drawing. In general, the orientation and crystallization of polypropylene is fastest at a temperature between about 110 and 120° C., and at a given temperature the speed is faster under a condition to produce a stretched state. Therefore, the control of heat and stress applied to the fiber in the drawing process is an important factor for inhibiting the orientation and crystallization of the resin. Specifically, the resistance of incipient tension of the heat-fusible composite fiber is preferably made 15 gf/D $\{132.4\times10^{-3}$ N/dtex$\}$ or less, by controlling the temperature of the resin, the cooling conditions of the fiber, and the balance between the resin discharge rate and the fiber drawing speed in the spinning process; and the set temperature, drawing speed, and draw ratio, in the drawing process.

If the resistance of incipient tension of. the heat-fusible composite fiber exceeds 15 gf/D $\{132.4\times10^{-3}$ N/dtex$\}$, the difference in melting points between sheath and core components decreases due to the rise in melting point caused by orientation and crystallization. For this reason, if the heat treatment of the web is performed under conditions to melt the sheath component sufficiently, the core component also approaches its melting temperature, and the entire fiber will melt, resulting in the loss of bulk and the deterioration of feeling (touch). Also, since the rigidity of the core component is lost, heat shrinkage of the fiber is likely to occur, raising problems of lowered dimension stability of the non-woven fabric, and the occurrence of irregularity in weight per unit area.

In contrast, the heat-fusible composite fiber of the present invention, which has been controlled to have a resistance of incipient tension of 15 gf/D $\{132.4\times10^{-3}$ N/dtex$\}$ or less, excels in thermal adhesion because the melting point of the sheath component is kept low by inhibiting orientation and crystallization. In addition, since the difference in melting points between the sheath and core components is not small the core component does not melt when the sheath component is melted, and non-woven fabrics which excel in both tenacity and feeling (touch) can be produced. Also, since the core component maintains rigidity during processing of the non-woven fabric, heat shrinkage is unlikely to occur.

However, the resistance of incipient tension is preferably not less than 5 gf/D, because the strength of the non-woven fabric lowers if the resistance of incipient tension is less than 5 gf/D.

Failure of a non-woven fabric is caused by the failure of bonded points of fibers due to tension, or by the failure of the fibers themselves. Therefore, when the bonded points of fibers are sufficiently strong, the tenacity of a non-woven fabric depends largely upon the single yarn strength of the fibers; whereas when bonded points of fibers are weak, the tenacity of a non-woven fabric depends upon the adhesion strength of the bonded points of fibers, and is little affected by the single yarn strength of the fibers. In ordinary non-woven fabrics, since the adhesion strength of the bonded points of fibers is lower than the single yarn strength of the fibers, the tenacity of non-woven fabrics is usually affected by the adhesion strength of the bonded points of fibers.

Since orientation and crystallization are inhibited in the heat-fusible composite fiber of the present invention, the single yarn strength of the fibers decreases. However, since the thermal adhesion of the bonded points of the fiber is improved, high tenacity of non-woven fabrics can be secured.

The heat-fusible composite fiber of the present invention is produced, through use of any well-known composite spinning method, into a coaxial sheath-core type or eccentric sheath-core type fiber through spinning, drawing, crimping, and then cutting to a desired length. The weight ratio of sheath and core components is preferably within a range between 20/80 and 70/30. If the content of the sheath component is less than 20 percent by weight, the thermal adhesion of the resultant fiber is lowered, and the desired tenacity and low-temperature adhesiveness of the non-woven fabric produced from such a fiber are compromised. If the content of the sheath component exceeds 70 percent by weight, the heat shrinkage of the fiber is increased and the dimensional stability tends to lower, although the thermal adhesion is sufficiently high.

The heat shrinkage of the composite fiber of the present invention is 15 percent or less. Heat shrinkage exceeding 15 percent is not preferable because this lowers the dimensional stability of the non-woven fabric during processing. Although this value is preferably as low as possible, the minimum value achieved in practice is about 5 percent.

The composite fiber is preferably of a coaxial type in consideration of the shrinkage of the web during heat treatment, and if an eccentric type composite fiber is to be produced, the reduction of fiber shrinkage by decreasing eccentricity should be considered. For good processability the fineness of the fiber is preferably 0.5 to 10.0 D {0.5 to 11.1 dtex}, the number of crimps is preferably 3 to 60 crimps/25 mm, and the fiber length is preferably 25 to 75 mm when a web is produced by carding, and 3 to 30 mm when a web is produced by air-flow opening.

The non-woven fabric of the present invention may be produced by known methods in which a web having a desired weight per unit area (METSUKE) is produced from heat-fusible composite fiber by carding or air-flow opening, and the web in turn is processed into a non-woven fabric through use of the hot-air adhesion method or the heat and pressure method.

When the fiber is used as the surface material for hygienic products such as paper diapers and sanitary napkins, the single yarn fineness is preferably 0.5 to 10.0 D {0.5 to 11.0 dtex}, and the weight per unit area (METSUKE) of the non-woven fabric is preferably 8 to 50 g/m$^2$, more preferably 10 to 30 g/m$^2$. If the single yarn fineness is less than 0.5 D {0.5 dtex}, uniform webs will be difficult to obtain; if the single yarn fineness exceeds 10.0 D {11.1 dtex}, the texture of the non-woven fabric will become coarse, and even if such a material is used as the surface material for hygienic products, the products will have undesirably rough and rigid feeling. If the weight per unit area (METSUKE) is less than 8 g/m$^2$, sufficient tenacity of the non-woven fabric cannot be achieved because the non-woven fabric will become excessively thin; if it exceeds 50 g/m$^2$, the non-woven fabric will become impractical because of poor feeling and high costs despite sufficient tenacity.

With the heat-fusible composite fiber of the present invention, other fibers may be mixed within the range not to affect the advantages of the present invention. Examples of these other fibers include polyester fibers, polyamide fibers, polyacrylic fibers, polypropylene fibers, and polyethylene fibers. When mixed with other fibers the content of the fiber of the present invention is generally 20 percent or more relative to the weight of the non-woven fabric. If the content of the fiber of the present invention is less than 20 percent, sufficient tenacity and heat sealing properties cannot be obtained.

PREFERRED EMBODIMENTS

The present invention will be described in further detail with reference to examples; however, the present invention should not be construed as limited thereto. Various physical properties in Examples and Comparative Examples were measured through use of the following methods:

Resistance of Incipient Tension

A bundle of fibers having a total denier number of about 20 D {about 22 dtex} was taken as the sample. The tensile test was conducted under the conditions of a test length of 100 mm and a tensile speed of 100 mm/min, and the resistance of incipient tension of the fiber was calculated from the change in load for change in elongation between elongation of 2 mm and 3 mm according to the following equation.

$$\text{Resistance of incipient tension (gf/D)} = \frac{P2 - P1}{\frac{1}{100} \times Td}$$

where P1: load at an elongation of 2 mm (gf)

P2: load at an elongation of 3 mm (gf)

Td: total Denier number (D)

Strength and Elongation of the Fiber

A bundle of fibers having a total denier number of 800 to 1,200 D {888 to 1,333 dtex} was taken as the sample. The test was conducted under conditions of a test length of 100 mm and a tensile speed of 100 mm/min, and the strength of the fiber was calculated from the maximum load according to the following equation:

$$\text{Strength of the fiber (gf/D)} = \frac{F}{Td}$$

where, F: Load at maximum loading (gf)

Td: Total denier number (D)

The distance between clamps at maximum loading was measured, and the elongation of the fiber was calculated according to the following equation.

$$\text{Elongation of the fiber (\%)} = \frac{L}{L_0} \times 100$$

where, L: Distance between clamps at maximum loading (mm)

$L_0$: Original distance between clamps (mm)

Heat Shrinkage of the Fiber

A fiber of a test length of 100 cm was sampled, the length of the fiber was measured after heat treatment at 140° C. for 5 minutes in a hot-air circulating dryer, and the heat shrinkage was calculated according to the following equation:

$$\text{Heat shrinkage of the fiber (\%)} = \frac{100 - M}{100} \times 100$$

where, M: Length of the fiber after heat treatment (cm)

Tenacity of the point-bonded non-woven fabric (20 g/m$^2$ converted tenacity):

A non-woven fabric having a weight per unit area (METSUKE) of about 20 g/m$^2$ was produced by subjecting a web produced by a carding machine to heat treatment with thermocompression bonding equipment consisting of an embossing roll having a 24 percent land area and a smooth metal back roll. The non-woven fabric was then heated to a predetermined temperature under the conditions of a line pressure of 20 kg/cm, a speed of 6 m/min, and processing temperatures of 120° C., 124° C., and 128° C. The traveling direction of the machine was represented by <MD>, and the direction normal to the traveling direction of the machine was represented by <CD>. Test specimens each having a length of 15 cm and a width of 5 cm were prepared, and the tenacity was measured through use of a tensile testing machine under conditions of a clamp distance of 10 cm and a tensile speed of 20 cm/min. The maximum load was deemed as the tenacity of the non-woven fabric, and was converted to MD tenacity and CD tenacity for 20 g/m$^2$, and BI tenacity was calculated from the geometric mean of MD and CD tenacities.

Bending Resistance:

Bending resistance was measured in accordance with the method specified by Japanese Industrial Standards (JIS) L-1096 (45° cantilever method).

Tenacity of the through-air non-woven fabric (20 g/m$^2$ converted tenacity):

A non-woven fabric having a weight per unit area (METSUKE) of about 20 g/m$^2$ was produced by subjecting a web produced by a carding machine to heat treatment with a suction band dryer. The non-woven fabric was then heated to a predetermined temperature under the conditions of a wind velocity of 2 m/sec; a conveyor speed of 8.5 m/min, and processing temperatures of 142° C., 145° C., and 148° C. The traveling direction of the machine was represented by <MD>, and the direction normal to the traveling direction of the machine was represented by <CD>. Test specimens each having a length of 15 cm and a width of 5 cm were prepared, and the tenacity was measured through use of a tensile testing machine under conditions of a clamp distance of 10 cm and a tensile speed of 20 cm/min. The maximum load was deemed as the tenacity of the non-woven fabric, and was converted to MD tenacity and CD tenacity for 20 g/m$^2$, and BI tenacity was calculated from the geometric mean of MD and CD tenacities.

Specific Volume:

The weight and thickness of a 150×150 mm non-woven fabric were measured, and the specific volume of the non-woven fabric was calculated according to the following equation:

$$\text{Specific volume (cm}^3\text{)} = \frac{t \times 150 \times 150}{W \times 1000}$$

where, t: Thickness of the non-woven fabric (mm)

W: Weight of the non-woven fabric (g)

Feeling

A feeling test was conducted by 10 panelists, and the samples for which at least 9 panelists, 7 to 8 panelists, and 5 to 6 panelists judged as "soft" were evaluated as Excellent, Good, and Fair, respectively. The samples which 6 or more panelists judged as "not soft" were evaluated as Poor. Excellent, Good, Fair, and Poor are indicated by ⊚,○,Δ, and X, respectively.

EXAMPLE 1

A sheath-and-core type non-stretched composite fiber of a fineness of 3.0 D {3.3 dtex} was produced from an olefin-based terpolymer consisting of 3.0 percent by weight of ethylene, 2.0 percent by weight of butene-1, and 95.0 percent by weight of propylene, and having an MFR of 15 as the sheath component; and a crystalline polypropylene (homopolymer) having an MFR of 10 as the core component, through use of a composite spinning machine having a nozzle 0.6 mm in diameter, under conditions of a combining ratio of 40/60 (sheath component/core component), a spinning temperature of 280° C., and a drawing speed of 800 m/min, or 80 percent of the normal speed of 1,000 m/min. The yarn was stretched to 1.5 times its original length through use of hot rolls at 95° C., mechanically crimped through use of a stuffer box, dried at 90° C., and cut to form a composite fiber of 2.3 D {2.6 dtex}×38 mm.

COMPARATIVE EXAMPLE 1

Composite fiber staples were produced under the same conditions as in Example 1 except that the drawing speed on spinning was 1,000 m/min, and the stretching ratio and the zineness of the non-stretched composite fiber were 2.4 times and 2.0 D {2.2 dtex}, respectively.

EXAMPLE 2

Composite fiber staples were produced under the same conditions as in Example 1 except that a terpolymer consisting of 4.0 percent by weight of ethylene, 3.0 percent by weight of butene-1, and 93.0 percent by weight of propylene, and having an MFR of 15 was used as the sheath component, the single yarn fineness of the non-stretched composite fiber was 3.2 D {3.5 dtex}, and the fineness of the composite fiber was 2.5 D {2.8 dtex}.

EXAMPLE 3

Composite fiber staples were produced under the same conditions as in Example 2 except that the combining ratio was 50/50 (sheath component/core component), the drawing speed was 500 m/min, or 50 percent of the normal speed of 1,000 m/min, the single yarn fineness of the non-stretched composite fiber was 8.5 D {9.4 dtex}, and the stretching ratio and the fineness of the composite fiber were 3.0 times and 3.3 D {3.6 dtex}, respectively.

COMPARATIVE EXAMPLE 2

Composite fiber staples were produced under the same conditions as in Example 2 except that the drawing speed on spinning was 1,000 m/min, the single yarn fineness of the non-stretched composite fiber was 4.3 D {4.7 dtex}, and the stretching ratio and the fineness of the composite fiber were 2.4 times and 2.1 D {2.3 dtex}, respectively.

EXAMPLE 4

Composite fiber staples were produced under the same conditions as in Example 1 except that a binary copolymer consisting of 3.5 percent by weight of ethylene and 96.5 percent by weight of propylene and having an MFR of 15 was used as the sheath component, the single yarn fineness of the non-stretched composite fiber was 3.4 D {3.7 dtex}, and the stretching ratio and the fineness of the composite fiber were 2.0 times and 2.0 D {2.2 dtex}, respectively.

COMPARATIVE EXAMPLE 3

Composite fiber staples were produced under the same conditions as in Example 4 except that the drawing speed on spinning was 1,000 m/min, the single yarn fineness of the non-stretched composite fiber was 3.9 D {4.3 dtex}, and the stretching ratio and the fineness of the composite fiber were 2.4 times and 1.9 D {2.1 dtex}, respectively.

EXAMPLE 5

Composite fiber staples were produced under the same conditions as in Example 1 except that the combining ratio was 30/70 (sheath component/core component), a binary copolymer consisting of 5.5 percent by weight of ethylene and 94.5 percent by weight of propylene and having an MFR of 23 was used as the sheath component, the drawing speed was 700 m/min, or 70 percent the normal speed of 1,000 m/min, the single yarn fineness of the non-stretched composite fiber was 4.3 D {4.7 dtex}, and the stretching ratio and the fineness of the composite fiber were 2.4 times and 2.1 D {2.4 dtex}, respectively.

The results of physical property measurement of heat-fusible composite fibers according to above Examples and Comparative Examples are shown in Table 1. Relationships between the point-bonding temperature of these fibers and the physical properties of non-woven fabrics are shown in Table 2. Relationships between the through-air processing temperature of these fibers and the physical properties of non-woven fabrics are shown in Table 3. The results of evaluation for the touch of non-woven fabrics showing the similar tenacity, for each of point-bonded non-woven fabrics and through-air non-woven fabrics, are shown in Table 4.

The results of property evaluation of point-bonded non-woven fabrics (see Table 2) show that the heat-fusible composite fibers of the present invention in Examples 1 through 5 can be processed into non-woven fabrics having high tenacity at lower processing temperatures than can the heat-fusible fibers in Comparative Examples 1 through 3. The results also verify that the non-woven fabrics made from the heat-fusible composite fibers of the present invention in Examples 1 through 5 have lower bending resistance, indicating their excellent softness relative-to the non-woven fabrics made of the heat-fusible composite fibers of Comparative Examples 1 through 3.

The results of property evaluation of through-air non-woven fabrics (see Table 3) verify that heat-fusible composite fibers having higher resistance of incipient tension yield a large increase in the tenacity of non-woven fabrics with increasing processing temperature. This is because fiber intermingling points have increased in number due to a decrease in the bulk of the non-woven fabrics, as is also seen from the extreme decrease in specific volume. Since the non-woven fabrics made of the heat-fusible fibers of the present invention have high tenacity even if the processing temperature is low, and have little decrease in specific volume with increasing processing

TABLE 1

Properties of composite fibers

| | Material resin | | | | Composite fiber | | | | | | |
|---|---|---|---|---|---|---|---|---|---|---|---|
| | CO-PP | | | PP | Sheath-core ratio sheath/core | Stretching ratio | Fineness of composite Fiber D | Strength gf/D | Elongation % | Fiber shrinkage % | Resistance of incipient tension gf/D |
| | Ethylene Wt % | Butene-1 Wt % | MFR g/10 min. | MFR g/10 min. | | | | | | | |
| Example 1 | 3.0 | 2.0 | 15 | 10 | 40/60 | 1.5 | 2.3 | 1.6 | 285 | 10.0 | 10.3 |
| Comp. Ex. 1 | 3.0 | 2.0 | 15 | 10 | 40/60 | 2.4 | 2.0 | 2.7 | 140 | 17.5 | 20.1 |
| Example 2 | 4.0 | 3.0 | 15 | 10 | 40/60 | 1.5 | 2.5 | 1.7 | 225 | 9.1 | 9.8 |
| Example 3 | 4.0 | 3.0 | 15 | 10 | 50/50 | 3.0 | 3.3 | 1.9 | 210 | 13.7 | 13.5 |
| Comp. Ex. 2 | 4.0 | 3.0 | 15 | 10 | 40/60 | 2.4 | 2.1 | 2.9 | 135 | 18.0 | 18.4 |
| Example 4 | 3.5 | — | 15 | 10 | 40/60 | 2.0 | 2.0 | 2.0 | 205 | 14.6 | 14.3 |
| Comp. Ex. 3 | 3.5 | — | 15 | 10 | 40/60 | 2.4 | 1.9 | 2.6 | 150 | 18.7 | 22.2 |
| Example 5 | 5.5 | — | 23 | 10 | 30/70 | 2.4 | 2.1 | 2.4 | 220 | 13.1 | 12.4 |

TABLE 2

Properties of point-bonded non-woven fabrics

| | Processing temperature ° C. | 20 g/m² converted tenacity MD kgf/5 cm | CD kgf/5 cm | BI kgf/5 cm | Bending resistance mm |
|---|---|---|---|---|---|
| Example 1 | 120 | 5.46 | 0.79 | 2.08 | 29.7 |
| | 124 | 6.32 | 1.32 | 2.89 | 35.3 |
| | 128 | 6.54 | 1.62 | 3.25 | 40.1 |
| Comparative Example 1 | 120 | 0.95 | 0.14 | 0.36 | 25.1 |
| | 124 | 1.77 | 0.28 | 0.70 | 27.2 |
| | 128 | 4.70 | 0.67 | 1.77 | 33.8 |
| Example 2 | 120 | 5.15 | 0.82 | 2.05 | 30.2 |
| | 124 | 5.87 | 1.41 | 2.88 | 37.4 |
| | 128 | 6.01 | 1.75 | 3.24 | 43.7 |
| Example 3 | 120 | 1.83 | 0.52 | 0.98 | 28.6 |
| | 124 | 4.68 | 0.85 | 1.99 | 32.7 |
| | 128 | 5.97 | 1.45 | 2.94 | 42.1 |
| Comparative Example 2 | 120 | 1.06 | 0.18 | 0.44 | 25.5 |
| | 124 | 1.66 | 0.35 | 0.76 | 29.4 |
| | 128 | 4.49 | 0.73 | 1.81 | 34.3 |
| Example 4 | 120 | 1.67 | 0.48 | 0.90 | 27.5 |
| | 124 | 4.23 | 0.79 | 1.83 | 32.3 |
| | 128 | 6.19 | 1.38 | 2.92 | 42.4 |
| Comparative Example 3 | 120 | 0.98 | 0.11 | 0.33 | 24.3 |
| | 124 | 1.68 | 0.24 | 0.63 | 26.8 |
| | 128 | 4.78 | 0.58 | 1.67 | 32.1 |

TABLE 2-continued

| | Properties of point-bonded non-woven fabrics | | | | |
|---|---|---|---|---|---|
| | Processing | 20 g/m² converted tenacity | | | Bending |
| | temperature ° C. | MD kgf/5 cm | CD kgf/5 cm | BI kgf/5 cm | resistance mm |
| Example 5 | 120 | 2.02 | 0.61 | 1.11 | 29.6 |
| | 124 | 4.58 | 0.91 | 2.04 | 32.7 |
| | 128 | 5.36 | 1.50 | 2.84 | 36.3 |

TABLE 3

| | Properties of through-air non-woven fabrics | | | | |
|---|---|---|---|---|---|
| | Processing | 20 g/m² converted tenacity | | | Specific |
| | temperature ° C. | MD kgf/5 cm | CD kgf/5 cm | BI kgf/5 cm | volume cm²/g |
| Example 1 | 142 | 3.61 | 0.63 | 1.51 | 65.8 |
| | 145 | 4.97 | 0.75 | 1.93 | 56.8 |
| | 148 | 5.89 | 1.14 | 2.59 | 40.0 |
| Comparative Example 1 | 142 | 0.98 | 0.10 | 0.31 | 41.3 |
| | 145 | 5.63 | 0.35 | 1.40 | 28.8 |
| | 148 | 7.01 | 1.52 | 3.26 | 15.5 |
| Example 2 | 142 | 3.89 | 0.71 | 1.66 | 61.4 |
| | 145 | 4.81 | 0.76 | 1.91 | 58.2 |
| | 148 | 5.35 | 0.94 | 2.24 | 44.1 |
| Example 3 | 142 | 2.67 | 0.39 | 1.02 | 52.8 |
| | 145 | 4.52 | 0.61 | 1.66 | 40.7 |
| | 148 | 6.13 | 0.97 | 2.44 | 34.9 |
| Comparative Example 2 | 142 | 1.14 | 0.13 | 0.38 | 45.4 |
| | 145 | 5.80 | 0.39 | 1.50 | 30.9 |
| | 148 | 6.57 | 1.39 | 3.02 | 18.6 |
| Example 4 | 142 | 2.55 | 0.46 | 1.08 | 55.2 |
| | 145 | 4.50 | 0.69 | 1.76 | 46.4 |
| | 148 | 6.21 | 1.20 | 2.73 | 35.1 |
| Comparative Example 3 | 142 | 0.84 | 0.08 | 0.26 | 52.7 |
| | 145 | 5.60 | 0.45 | 1.59 | 36.8 |
| | 148 | 7.11 | 1.64 | 3.41 | 15.7 |
| Example 5 | 142 | 3.07 | 0.55 | 1.30 | 54.6 |
| | 145 | 4.64 | 0.65 | 1.74 | 49.8 |
| | 148 | 5.99 | 0.91 | 2.33 | 40.1 |

TABLE 4

| | Results of feeling test | | | | | |
|---|---|---|---|---|---|---|
| | Point-bonded non-woven fabric | | | Through-air non-woven fabric | | |
| | Processing temperature ° C. | BI tenacity kgf/5 cm | Feeling | Processing temperature ° C. | BI tenacity kgf/5 cm | Feeling |
| Example 1 | 120 | 2.08 | ◎ | 142 | 1.51 | ◎ |
| Comp. Ex. 1 | 128 | 1.77 | Δ | 145 | 1.40 | X |
| Example 2 | 120 | 2.05 | ◎ | 142 | 1.66 | ◎ |
| Example 3 | 124 | 1.99 | ○ | 145 | 1.66 | ○ |
| Comp. Ex. 2 | 128 | 1.81 | X | 145 | 1.50 | X |
| Example 4 | 124 | 1.83 | ○ | 145 | 1.76 | ○ |
| Comp. Ex. 3 | 128 | 1.67 | ○ | 145 | 1.59 | Δ |
| Example 5 | 124 | 2.04 | ○ | 145 | 1.74 | ○ |

temperature, these non-woven fabrics are verified to have little decrease in bulk due to heat shrinkage during processing, and to excel in dimensional stability and softness.

When non-woven fabrics having the same degree of tenacity are compared, as Table 4 shows, the non-woven fabrics made of the heat-fusible composite fibers of the present invention in Examples 1 through 5 exhibit better results in the evaluation of touch by panelists than do heat-fusible fibers in Comparative Examples 1 through 3.

INDUSTRIAL APPLICABILITY

The heat-fusible fiber according to the present invention excels in fiber bonding processability by heat treatment-at low processing temperatures. Therefore, it can be processed into non-woven fabrics having high dimensional stability, high tenacity, and excellent feeling (touch). Since these non-woven fabrics have excellent feeling (touch) as well as strong fiber intermingling points, failure due to stretching and the like is unlikely to occur, making these non-woven fabrics useful for use in hygienic products such as paper diapers and sanitary napkins.

What is claimed is:

1. A heat-fusible composite fiber comprising a sheath component of a crystalline propylene copolymer resin having a low melting point and a core component of a crystalline polypropylene resin having a higher melting point, wherein said fiber has a resistance of incipient tension of 5 to 15 gf/D $\{44.1\times10^{-3}$ to $132.4\times10^{-3}$ N/dtex$\}$, and a heat shrinkage of 15 percent or less at 140° C. over 5 minutes.

2. A heat-fusible composite fiber according to claim 1, wherein said crystalline propylene copolymer resin having a low melting point is a copolymer resin comprising of 85 to 99 percent by weight of propylene and 1 to 15 percent by weight of ethylene.

3. A heat-fusible composite fiber according to claim 1, wherein said crystalline propylene copolymer resin having a low melting point is a copolymer resin comprising of 50 to 99 percent by weight of propylene and 1 to 50 percent by weight of butene-1.

4. A heat-fusible composite fiber according to claim 1, wherein said crystalline propylene copolymer resin having a low melting point is a copolymer resin consisting of 84 to 97 percent by weight of propylene, 1 to 10 percent by weight of ethylene, and 1 to 15 percent by weight of butene-1.

5. A heat-fusible composite fiber according to claim 1, which has a fiber strength of 1.2 to 2.5 gf/D $\{10.6\times10^{-3}$ to $22.1\times10^{-3}$ N/dtex$\}$, and an elongation of 200 to 500 percent.

6. A non-woven fabric made of a heat-fusible composite fiber according to claim 1, wherein fibers at crossing points are thermally adhered by a hot air method.

7. A non-woven fabric made of a heat-fusible composite fiber according to claim 1, wherein fibers at crossing points are thermally adhered by heat and pressure.

* * * * *

UNITED STATES PATENT AND TRADEMARK OFFICE

CERTIFICATE OF CORRECTION

PATENT NO. : 6,156,679
DATED : December 5, 2000
INVENTOR(S) : Yukinori Kataoka, et. al.

It is certified that error appears in the above-identified patent and that said Letters Patent is hereby corrected as shown below:

Title page, should read item [75] Inventors: Yukinori Kataoka; Mitsuru Kojima; Masayasu Suzuki, all of Shiga, Japan Signed and Sealed this First Day of May, 2001

*Attest:*

Nicholas P. Godici

NICHOLAS P. GODICI

*Attesting Officer*

*Acting Director of the United States Patent and Trademark Office*